US007305100B2

(12) United States Patent
Pedersen

(10) Patent No.: US 7,305,100 B2
(45) Date of Patent: Dec. 4, 2007

(54) DYNAMIC COMPRESSION IN A HEARING AID

(75) Inventor: Brian Dam Pedersen, Ringsted (DK)

(73) Assignee: GN ReSound A/S (DK)

( * ) Notice: Subject to any disclaimer, the term of this patent is extended or adjusted under 35 U.S.C. 154(b) by 601 days.

(21) Appl. No.: 10/778,653

(22) Filed: Feb. 13, 2004

(65) Prior Publication Data

US 2005/0008176 A1 Jan. 13, 2005

(30) Foreign Application Priority Data

Feb. 14, 2003 (DK) ..... 2003 00228

(51) Int. Cl.
*H04R 25/00* (2006.01)

(52) U.S. Cl. ..... 381/320; 381/321; 381/106

(58) Field of Classification Search ..... 381/320, 381/321, 103, 106
See application file for complete search history.

(56) References Cited

U.S. PATENT DOCUMENTS

| | | | | |
|---|---|---|---|---|
| 4,156,116 | A * | 5/1979 | Yanick | 381/106 |
| 4,630,305 | A * | 12/1986 | Borth et al. | 381/320 |
| 4,815,023 | A * | 3/1989 | Arbeiter | 708/301 |
| 4,852,175 | A * | 7/1989 | Kates | 381/320 |
| 5,572,443 | A * | 11/1996 | Emoto et al. | 381/103 |
| 5,724,433 | A * | 3/1998 | Engebretson et al. | 381/106 |
| 6,097,824 | A | 8/2000 | Lindemann et al. | 381/315 |
| 6,119,080 | A | 9/2000 | Liu et al. | 704/203 |
| 6,198,830 | B1 | 3/2001 | Holube et al. | 381/370 |
| 2002/0076072 | A1 | 6/2002 | Cornelisse | 381/312 |
| 2002/0150269 | A1 * | 10/2002 | Ludvigsen | 381/316 |
| 2003/0002699 | A1 * | 1/2003 | Schulz et al. | 381/316 |
| 2003/0012391 | A1 * | 1/2003 | Armstrong et al. | 381/314 |

FOREIGN PATENT DOCUMENTS

| | | |
|---|---|---|
| GB | 2 350956 A | 12/2000 |
| JP | 5243910 | 9/1993 |
| WO | WO 98/56210 | 12/1998 |

OTHER PUBLICATIONS

Harma, Aki et al.; Frequency-warped signal processing for audio applications; J. Audio Eng. Soc. vol. 48, No. 11, Nov. 2000, pp. 1011-1031.*

Koilpillai, R.D.; Vaidyanathan, P.P.; New results on cosine-modulated FIR filter banks satisfying perfect reconstruction; Acoustics, Speech, and Signal Processing, 1991. ICASSP-91., 1991 International Conference on Apr. 14-17, 1991 pp. 1793-1796 vol. 3.*

* cited by examiner

*Primary Examiner*—Daniel Swerdlow
(74) *Attorney, Agent, or Firm*—Bingham McCutchen LLP

(57) ABSTRACT

The present invention relates to a hearing aid with a compressor having a low and gain independent delay and low power consumption. The hearing aid comprises a multichannel compressor for compensation of dynamic range loss and with a digital input for inputting a digital sound signal, and an output connected to an amplifier with a selectable gain as a function of frequency for compensation of frequency dependent hearing loss, and connected to an output for outputting the processed digital sound signal.

29 Claims, 2 Drawing Sheets

DYNAMIC COMPRESSION IN A HEARING AID

RELATED APPLICATION DATA

This application claims priority to Danish Patent Application No. PA2003 00228, filed on Feb. 13, 2006, the entire disclosure of which is expressly incorporated by reference herein.

FIELD OF THE INVENTION

The present invention relates to a hearing aid with a compressor having a low and gain independent delay and low power consumption, and a method utilized in the hearing aid.

BACKGROUND OF THE INVENTION

A hearing impaired person typically suffers from a loss of hearing sensitivity that is frequency dependent and dependent upon the sound level. Thus, a hearing impaired person may be able to hear certain frequencies (e.g., low frequencies) as well as a non-hearing impaired person, but unable to hear sounds with the same sensitivity as the non-hearing impaired person at other frequencies (e.g. high frequencies). Similarly, the hearing impaired person may be able to hear loud sounds as well as the non-hearing impaired person, but unable to hear soft sounds with the same sensitivity as the non-hearing impaired person. Thus, in the latter situation, the hearing impaired person suffers from a loss of dynamic range.

With respect to dynamic range loss, typically a compressor is used to compress the dynamic range of the input sound so that it more closely matches the dynamic range of the intended user. The slope of the input-output compressor transfer function ($\Delta I/\Delta O$) is referred to as the compression ratio. Generally the compression ratio required by a user is not constant over the entire input power range.

SUMMARY OF THE INVENTION

According to a first aspect of the present invention, a hearing impairment compensation method is provided comprising the steps of converting sound into an electrical signal, compressing the electrical signal for compensation of the loss of dynamic range of the hearing impairment in question, amplifying the compressed electrical signal with a frequency dependent gain for compensation of the frequency dependent hearing impairment in question, and converting the amplified signal to sound.

According to a second aspect of the invention, a hearing aid is provided comprising a multi-channel compressor for compensation of dynamic range hearing loss and with a digital input for inputting a digital sound signal, and an output connected to an amplifier with an adjustable gain as a function of frequency for compensation of a frequency dependent hearing loss, and connected to an output for outputting the processed digital sound signal.

The amplifier with adjustable gain provides a frequency response shaping system, preferably with high resolution, for frequency dependent hearing impairment compensation. The gains are determined by audiological measurements, such as determination of hearing threshold as a function of frequency, during initial adaptation of the hearing aid to a user.

The amplifier may comprise a minimum phase filter for provision of a minimum group delay. Preferably, the amplifier comprises a high-resolution minimum-phase Finite Impulse Response (FIR) filter. Minimum-phase FIR filtering is a digital filtering technique that is particularly suitable for both continuous and transient signal processing, and it offers the lowest possible processing delay in a digital application. Further, it is believed that minimum-phase FIR filtering processes transient sounds in a way that corresponds better to auditory system processing than other digital filter techniques. The gain settings of the amplifier determine the gain of the hearing aid according to the invention for soft and moderate level inputs to the hearing aid.

Each of the individual compressors in the multi-channel compressor provides attenuation of the input signal. Different gains are provided to different sound levels. Typically, the same gain is applied to all sounds below a given sound pressure level (the knee-point) while the gain drops above the knee-point (the compression region).

It is an important aspect of the present invention that the compressor operates on the sound signal before hearing loss compensation. Compression gain relates to input sound level. It is therefore important to determine the input level accurately in every compressor frequency channel. If hearing loss is compensated before compression then the determined input levels will be contaminated with the gain applied to compensate hearing impairment, and since the gain typically varies with frequency within a specific compressor channel, this typically leads to frequency dependent knee-points within the channels. This effect is avoided in a hearing aid according to the present invention.

Further, the separation of frequency dependent hearing loss compensation (static gain) from compression leads to easily manageable simultaneous compensation of frequency dependent hearing loss and loss of dynamic range.

The multi-channel compressor may comprise a filter bank with linear phase filters. Linear phase filters provide a constant group delay leading to low distortion.

Alternatively, the filter bank may comprise warped filters leading to a low delay, i.e. the least possible delay for the obtained frequency resolution, and adjustable crossover frequencies of the filter bank.

The filter bank is preferably a cosine-modulated structure. A cosine-modulated structure is very efficiently implemented and can be designed so that summation of the channel output signals equals unity in the case that all gains are 0 dB (no inherent dips or bumps in the frequency response). For example a 3-channel cosine modulated structure retains its sum-to-one property when the number of taps does not exceed 7. Few taps are desired to minimize the delay and the computational load. A filter bank with three 5-tap filters has been found to provide the minimum number of filters and taps with good performance. The sum-to-one property is demonstrated below for a linear-phase filter bank:

Cosine modulation gives a low-pass filter of the form:

$[b_0\ b_1\ b_2\ b_1\ b_0]$, a band-pass filter of the form:

$[-2b_0\ 0\ 2b_2\ 0\ -2b_0]$, and a high-pass filter of the form:

$[b_0\ -b_1\ b_2\ -b_1\ b_0]$

Summation of these three filters: $[0\ 0\ 4b_2\ 0\ 0]$, and preferably $b_2=1/4$.

It can also be shown that the resulting filter is symmetric (thus the group delay of the resulting filter is constant) independent of the gain factors $g_1$, $g_2$, $g_3$ of the individual filters:

$$g_1[b_0\ b_1\ b_2\ b_1\ b_0]+g_2[-2b_0\ 0\ 2b_2\ 0\ -2b_0]+g_3[b_0\ -b_1\ b_2\ -b_1\ b_0]=[b_0(g_1-2g_2+g_3)\ b_1(g_1-g_3)\ b_2(g_1+2g_2+g_3)\ b_1(g_1-g_3)\ b_0(g_1-2g_2+g_3)]$$

This ensures that the compressor does not exhibit phase distortion that can destroy the sense of directivity for the user.

The principles of digital frequency warping are known and therefore only a brief overview follows. Frequency warping is achieved by replacing the unit delays in a digital filter with first-order all-pass filters. The all-pass filters implement a bilinear conformal mapping that changes the frequency resolution at low frequencies with a complementary change in the frequency resolution at high frequencies.

The z-transform of an all-pass filter used for frequency warping is given by:

$$A(z) = \frac{\lambda + z^{-1}}{1 + \lambda z^{-1}}$$

where $\lambda$ is the warping parameter. Increasing positive values of $\lambda$ leads to increased frequency resolution at low frequencies, and decreasing negative values of $\lambda$ leads to increased frequency resolution at high frequencies.

The warping parameter $\lambda$ controls the cross over frequencies. With only one warping parameter, there is a fixed relationship between the center frequency of the center (which is $\pi/2$ in the case of no warping) channel, and the crossover frequencies. The relationship is as follows, given warped frequency $\omega_d$ in radians between 0 and $\pi$ (in this example, the center channel center frequency which is actually the parameter that is controlled).

$\omega$ is determined by:

$$\omega=2\pi f/F_s$$

Where f is the frequency, and $F_s$ is the sample frequency.

The warping factor $\lambda$ is given by the equation:

$$\lambda = \frac{\sin\left(\frac{\omega_d - \omega}{2}\right)}{\sin\left(\frac{\omega_d + \omega}{2}\right)}$$

The crossover frequencies in radians can then be computed by evaluating the following for $\pi/3$ and $2\pi/3$ $$\omega_d = \angle\frac{e^{j\omega} - \lambda}{1 - \lambda e^{j\omega}}.$$

The multi-channel compressor may further comprise a multi-channel power estimator for calculation of the power in each of the frequency channels of the filter bank.

The multi-channel compressor may further comprise a multi-channel compressor gain control unit for applying an individual compressor gain in each of the compressor frequency channels in accordance with the respective, determined power estimator. A preferred embodiment of the invention has an individual gain control circuit for each compressor channel with an individually adjustable knee-point and compression characteristic. The knee-points are adjusted based on audiological measurements of the hearing impairment of the user in question.

Prior art hearing aids employ a filter bank in front of the compressor having more channels than the compressor and with different gains in different channels. Therefore, the effective knee-points of the compressor gain control circuits (of which there are fewer than the number of channels in the filter bank) vary with frequency.

According to the present invention, the compressor gain control unit operates directly on the input signal so that each compressor channel knee-point does not vary with input signal frequency.

The output signals from the filter bank are multiplied with the corresponding individual gain outputs of the compressor gain control unit and the resulting signals are added together to form the compressed signal that is input to the amplifier.

Preferably, the compressor gain is calculated and applied for a block of samples whereby required processor power is lowered. When the compressor operates on a block of signal samples at the time, the compressor gain control unit operates at a lower sample frequency than other parts of the system. This means that the compressor gains only change every N'th sample where N is the number of samples in the block. This may generate artifacts in the processed sound signal, especially for fast changing gains. In an embodiment of the present invention these artifacts are suppressed by provision of low-pass filters at the gain outputs of the compressor gain control unit for smoothing gain changes at block boundaries.

It should be noted that in an embodiment of the present invention, the frequency channels of the compressor are adjustable and may be adapted to the specific hearing loss in question. For example, frequency warping enables variable crossover frequencies in the compressor filter bank. Depending on the desired gain settings, the crossover frequencies are automatically adjusted to best approximate the response. During audiology measurements, the desired hearing aid gain is determined as a function of frequency at different sound input pressure levels whereby the desired compression ration as a function of frequency is determined. Finally, the crossover frequencies of the compressor filter bank are automatically optimized.

Further, the warped compressor according to the present invention has a short delay, e.g. 3.5 ms at 1600 Hz, and the delay is constant also when the compressor changes gain. The short delay is particularly advantageous for hearing aids with open earpieces, since direct and amplified sound combine in the ear canal. The constant delay is very important for preservation of inter-aural cues. If the delay varies, the sense of localization will deteriorate or disappear.

Further, the hearing aid may comprise an output compressor for limitation of the output power of the hearing aid and connected to the output of the amplifier. The output compressor keeps the signal output of the hearing aid within the dynamic range of the device. Preferably, the output compressor has infinite compression ratio and an adjustable knee-point. The compressor is adjusted such that the gain at the knee-point in combination with the gain formed by the integer multiplier does not exceed 0 dB.

Preferably, the output compressor is a single-channel output compressor, however, multi-channel output compressors are foreseen. Alternatively, other output limiting may be utilized as is well known in the art.

Still further, embodiments according to the present invention have low power consumption.

BRIEF DESCRIPTION OF THE DRAWINGS

Below, the invention will be further described and illustrated with reference to the accompanying drawings in which.

DETAILED DESCRIPTION OF PREFERRED EMBODIMENTS

Figure 1:
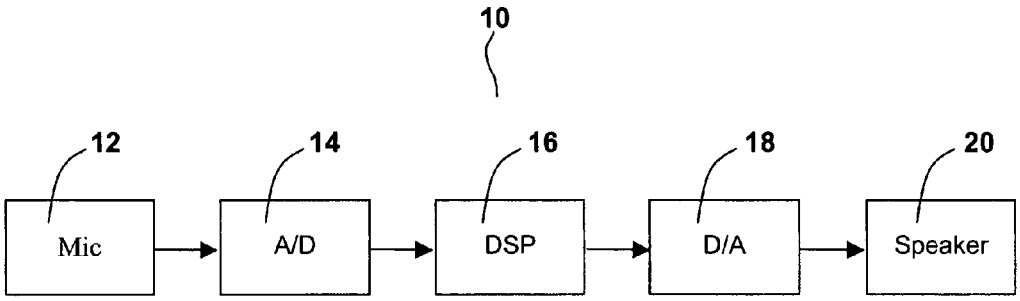
FIG. 1 is a block diagram of a hearing aid.

FIG. 1 is a simplified block diagram of a digital hearing aid 10. The hearing aid 10 comprises an input transducer 12, preferably a microphone, an analogue-to-digital (A/D) converter 14, a signal processor 16 (e.g. a digital signal processor or DSP), a digital-to-analogue (D/A) converter 18, and an output transducer 20, preferably a receiver. In operation, input transducer 12 receives acoustical sound signals and converts the signals to analogue electrical signals. The analogue electrical signals are converted by A/D converter 14 into digital electrical signals that are subsequently processed by DSP 16 to form a digital output signal. The digital output signal is converted by D/A converter 18 into an analogue electrical signal. The analogue signal is used by output transducer 20, e.g., a receiver, to produce an audio signal that is heard by the user of the hearing aid 10.

Figure 2:
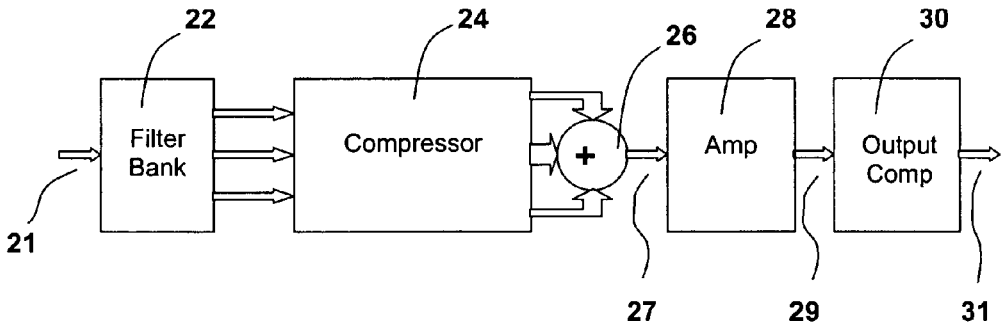
FIG. 2 is a block diagram of a compressor according to the present invention.
Figure 3:
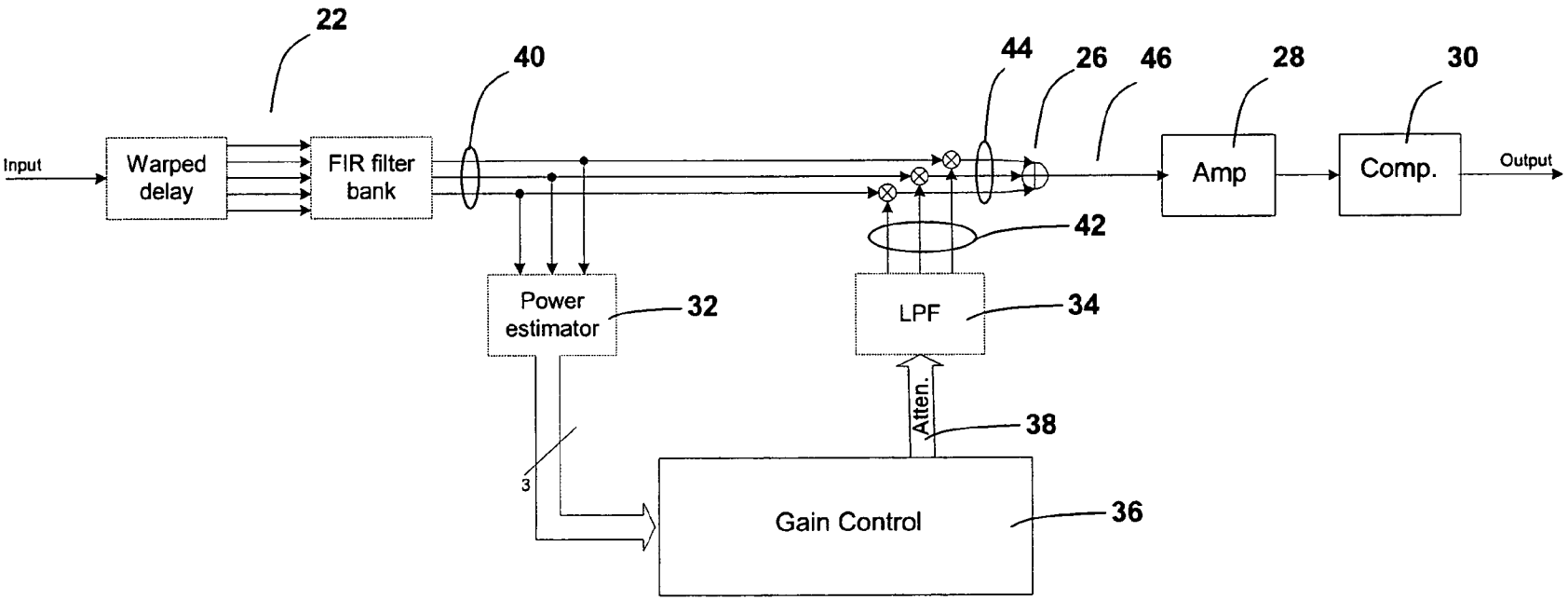
FIG. 3 is a more detailed block diagram of the embodiment shown in FIG. 2.

FIGS. 2 and 3 show parts of the signal processor 16 in more detail. In the embodiment illustrated in FIG. 2 and more detailed in FIG. 3, the hearing aid comprises a multi-channel compressor 22, 24, 26 with a digital input 21 for inputting a digital sound signal, and an output 27 connected to an amplifier 28 with a selectable static gain in each of its frequency channels for compensation of an individual hearing loss and connected to an output compressor 30 for limitation of the output 31 power of the hearing aid and connected to the output 29 of the amplifier 28.

In the illustrated embodiment, the output compressor 30 is a single-channel output compressor 30.

As illustrated in FIG. 3, the filter bank 22 comprises warped filters providing adjustable crossover frequencies, which are adjusted to provide the desired response in accordance with the users hearing impairment. The filters are 5-tap cosine-modulated filters.

Normally FIR filters work on a tapped delay line with one sample delay between the taps. By replacing the delays with first order all-pass filters, frequency warping is achieved enabling adjustment of crossover frequencies. The warped delay unit has five outputs. The five outputs constitutes a vector $w=[W_0\ W_1\ W_2\ W_3\ W_4]^T$ at a given point in time, which is led into the filter bank where the three channel output y, is formed. The filter bank is defined by:

$$B=\begin{bmatrix} b_0 & b_1 & b_2 & b_1 & b_0 \\ -2b_0 & 0 & 2b_2 & 0 & -2b_0 \\ b_0 & -b_1 & b_2 & -b_1 & b_0 \end{bmatrix}$$

The output of the filter bank y is:

$$y=Bw$$

The vector y contains the channel signals.

The choice of filter coefficients is a tradeoff between stop-band attenuation in the low and high frequency channels, and stop-band attenuation in the middle channel. The higher attenuation in the low and high frequency channels, the lower attenuation in the middle channel.

The multi-channel compressor further comprises a multi-channel power estimator 32 for calculation of the sound level or power in each of the frequency channels of the filter bank 22. The calculated values are applied to the multi-channel compressor gain control unit 36 for determination of a compressor channel gain to be applied to the signal output 40 of each of the filters of the filter bank 22.

The compressor gains 38 are calculated and applied batch-wise for a block of samples whereby required processor power is diminished. When the compressor operates on blocks of signal samples, the compressor gain control unit 36 operates at a lower sample frequency than other parts of the system. This means that the compressor gains only change every N'th sample where N is the number of samples in the block. Probable artifacts caused by fast changing gain values are suppressed by three low-pass filters 34 at the gain outputs 38 of the compressor gain control unit 36 for smoothing gain changes at block boundaries.

The output signals 40 from the filter bank 22 are multiplied with the corresponding individual low-pass filtered gain outputs 42 of the compressor gain control unit 36, and the resulting signals 44 are added 26 to form the compressed signal 46 that is input to the amplifier 28. The compressor provides attenuation only, i.e. the three compressors provide the difference between the desired gains for soft sounds and the desired gains for loud sounds.

The amplifier 28 provides frequency shaping that forms the desired gain for soft sounds, i.e. it compensates the frequency dependent part of the hearing impairment in question. The amplifier 28 has minimum-phase FIR filters with a suitable order. Minimum-phase filters guarantee minimum group delay in the system. The filter parameters are determined when the system is fitted to a patient and does not change during operation. The design process for minimum-phase filters is well known.

The hearing loss compensation and the dynamic compression may take place in different frequency bands, where the term different frequency bands means different number of frequency bands and/or frequency bands with different bandwidth and/or crossover frequency.

The invention claimed is:

1. A hearing aid comprising:

a multi-channel compressor for compensation of loss of dynamic range, the multi-channel compressor having a digital input for receiving a digital sound signal, and an output for outputting a compressed signal to an amplifier, wherein the amplifier has a selectable gain as a function of frequency for compensation of frequency dependent hearing loss and an output for outputting a processed digital sound signal.

2. A hearing aid according to claim 1, wherein the amplifier is a multichannel amplifier, and frequency channels of the multichannel amplifier are different from frequency channels of the multi-channel compressor.

3. A hearing aid according to claim 1, wherein the multi-channel compressor comprises a filter bank with linear phase filters.

4. A hearing aid according to claim 3, wherein the filter bank comprises warped filters.

5. A hearing aid according to claim 4, wherein crossover frequencies of the filter bank are adjustable.

6. A hearing aid according to claim 3, wherein the filter bank comprises cosine-modulated filters.

7. A hearing aid according to claim 3, wherein the filter bank comprises three 5-tap filters.

8. A hearing aid according to claim 1, wherein the multi-channel compressor further comprises a filter bank having frequency channels, and a multi-channel power estimator for calculation of the power in each of the frequency channels of the filter bank.

9. A hearing aid according to claim 8, wherein the multi-channel compressor comprises a multi-channel compressor gain control unit for applying an individual compressor gain in a frequency channel of the compressor in accordance with the respective power estimate.

10. A hearing aid according to claim 9, wherein the same gain is applied to all sounds below knee-points.

11. A hearing aid according to claim 1, wherein the multi-channel compressor further comprises a multi-channel compressor gain circuit for applying a compressor gain in one of the compressor channels to the input signal in accordance with a power estimate.

12. A hearing aid according to claim 11, wherein the compressor gain is calculated and applied for a block of samples.

13. A hearing aid according to claim 1, wherein the multi-channel compressor further comprises a multi-channel low-pass filter for low-pass filtering of a compressor gain.

14. A hearing aid according to claim 1, wherein the amplifier comprises a minimum phase filter.

15. A hearing aid according to claim 1, wherein the amplifier is a multichannel amplifier, and wherein the hearing aid further comprises an output compressor for limitation of an output power of the hearing aid, the output compressor being connected to the output of the multichannel amplifier.

16. A hearing aid according to claim 15, wherein the output compressor is a single-channel output compressor.

17. A hearing aid according to claim 1, wherein the multi-channel compressor has an individual gain control circuit for each compressor channel with an individually adjustable knee-point and compression characteristic.

18. A hearing aid according to claim 17, wherein the knee-points are adjusted based on audiological measurements of a hearing impairment of a user.

19. A hearing aid according to claim 1, further comprising the amplifier.

20. A hearing impairment compensation method comprising:

converting sound into an electrical signal, compressing the electrical signal for compensation of the loss of dynamic range of a hearing impairment, amplifying the compressed electrical signal with a frequency dependent gain for compensation of frequency dependent hearing impairment, and converting the amplified signal to sound.

21. A method according to claim 20, wherein the step of compressing further comprises filtering the electrical signal into a plurality of frequency channels.

22. A method according to claim 20, wherein the step of amplifying further comprises filtering the electrical signal into a plurality of frequency channels.

23. A method according to claim 20, wherein the step of compressing further comprises filtering the electrical signal into a plurality of frequency channels, and the step of amplifying further comprises filtering the electrical signal into a different plurality of frequency channels.

24. A hearing aid comprising:

a multi-channel compressor for compensation of loss of dynamic range, the multi-channel compressor having a digital input for receiving a digital sound signal and an output for outputting a compressed signal to an amplifier;

wherein the amplifier has a selectable gain as a function of frequency for provision of a desired gain for soft sounds for compensation of frequency dependent hearing loss, and an output for outputting a processed digital sound signal.

25. A hearing aid according to claim 24, further comprising the amplifier.

26. A hearing aid comprising:

a multi-channel compressor for compensation of loss of dynamic range, the multi-channel compressor having a digital input for receiving a digital sound signal and an output for outputting a compressed signal to an amplifier;

wherein the amplifier has a selectable gain for compensation of frequency dependent hearing loss, the gain being based on a hearing threshold determined as a function of frequency, the amplifier further having an output for outputting a processed digital sound signal.

27. A hearing aid according to claim 26, further comprising the amplifier.

28. A hearing aid comprising:

a multi-channel compressor for compensation of loss of dynamic range and for applying an identical gain to all sounds below a given sound pressure level, the multi-channel compressor having a digital input for receiving a digital sound signal and an output for outputting a compressed signal to an amplifier;

wherein the amplifier has a selectable gain as a function of frequency for compensation of frequency dependent hearing loss and an output for outputting a processed digital sound signal.

29. A hearing aid according to claim 28, further comprising the amplifier.

* * * * *